US005161475A

United States Patent [19]

Tawara et al.

[11] Patent Number: 5,161,475

[45] Date of Patent: Nov. 10, 1992

[54] RESIDUAL BOBBIN THREAD AMOUNT DETECTING APPARATUS FOR A SEWING MACHINE

[75] Inventors: Keizo Tawara; Kazuya Tami; Osamu Tachikawa, all of Chofu, Japan

[73] Assignee: Juki Corporation, Tokyo, Japan

[21] Appl. No.: 704,066

[22] Filed: May 22, 1991

[30] Foreign Application Priority Data

May 22, 1990 [JP] Japan ..... 2-133628

[51] Int. Cl.[5] ..... D05B 45/00

[52] U.S. Cl. ..... 112/278

[58] Field of Search ..... 112/278, 273, 275, 277, 112/121.11; 250/231.17

[56] References Cited

U.S. PATENT DOCUMENTS 4,192,243 3/1980 Blessing et al. ..... 112/273
4,934,292 6/1990 Mardix et al. ..... 112/273
4,938,159 7/1990 Shibata ..... 112/273
5,018,465 5/1991 Hager et al. ..... 112/273

FOREIGN PATENT DOCUMENTS 61-253098 10/1986 Japan .
62-7990 1/1987 Japan .
1335677 10/1973 United Kingdom ..... 112/273

*Primary Examiner*—Peter Nerbun
*Attorney, Agent, or Firm*—Morgan & Finnegan

[57] ABSTRACT

A residual bobbin thread amount detection apparatus for a sewing machine which includes a hook rotating in association with a main shaft of the sewing machine and a bobbin rotatably mounted on the hook. A first detector detects the rotation speed of the main shaft and a second detector detects the rotation speed of the bobbin. A comparator responsive to the second detector generates a signal when the rotation speed of the bobbin exceeds a predetermined value, whereby a controller operates an alarm.

12 Claims, 7 Drawing Sheets

RESIDUAL BOBBIN THREAD AMOUNT DETECTING APPARATUS FOR A SEWING MACHINE

BACKGROUND OF THE INVENTION

This invention relates to a sewing machine, and more particularly to a bobbin thread detection apparatus for sewing machines.

Lockstitch sewing machines conventionally include a small amount of bobbin thread wound on a bobbin. Since the thread is used up in a relatively short period of time, an inspection is frequently required to determine how much thread remains on the bobbin. Such inspection has been generally made by tilting a head of the sewing machine. However, this extra labor inevitably lowers the efficiency of the sewing operation. For this reason, various approaches have been made to automatically inspect how much bobbin thread remains wound on a bobbin when the residual or leftover amount of bobbin thread is less than a predetermined minimal amount.

Apparatuses which measure the amount of residual bobbin thread are broadly classified into those which are adapted for mechanical inspection and those which are adapted for optical inspection. The mechanical inspection apparatuses are used, for example, when the user is required to inspect the residual or leftover bobbin thread while it is wound on the bobbin such as when detection elements are adjusted according to variations depending upon the condition of the workpiece and the sewing operation. This operation could not be performed unless the head of the sewing machine is tilted, which requires the use of much operator labor.

Lately, there has been a tendency that bobbin thread inspections be made using an optical sensor. For example, one conventional optical inspection apparatus for detecting the residual or leftover bobbin thread, as shown in FIGS. 10A and 10B, is provided with an optical sensor C. More specifically, the apparatus of this class comprises a bobbin B which includes a flange Ba having a plurality of reflective elements B1 radially and equidistantly formed thereon. The reflective elements B1 of the flange Ba are adapted to irradiate light from an illuminator C1 to the flange Ba. A light receptive element C2 converts the light which is continuously reflected from the reflective elements B1 into a pulse signal.

When the main shaft rotates one-half turn, the number of pulse signals generated is detected, thereby determining the rotation speed of the bobbin. This measured bobbin rotation speed is then compared with the rotational speed of a bobbin which contains the preset minimum amount of thread. If the measured rotational speed is more than the preset speed, the operator is notified that the residual or leftover bobbin thread remaining is low, so that a new bobbin may be applied.

In other words, to cope with the aforementioned situation where the rotation speed of the bobbin is increased as the residual or leftover thread is reduced, the rotation speed of the bobbin is measured to determine whether or not the amount of residual or leftover thread is less than the present minimum amount.

However, the aforementioned apparatus as those which are adapted so that the amount of the residual or leftover thread is detected by the rotation speed of the bobbin B, involve a disadvantage in that the rotation speed of the bobbin is subjected to the coefficient of friction between the bobbin B and a bobbin case (not shown), thus necessitating resetting its rotation speed when another bobbin is exchanged therewith.

Another disadvantage is that the rotation speed of the bobbin varies considerably even where the main shaft rotates one revolution, resulting in unreliable speed data due to instability, thereby resulting in malfunction. For instance, the bobbin B is initially rotated at a high speed immediately after the bobbin thread is pulled up by a needle thread loop, but is thereafter decelerated since its rotation entirely relies upon inertia, thus causing a great change in its speed. Moreover, sewing speed is not always constant during one sewing cycle and the rotation speed of the bobbin also varies considerably by a change in the rotation speed of the main shaft.

For these reasons it is very difficult to precisely detect the amount of the residual or leftover thread, thereby resulting in many malfunctions.

It is therefore an object of the present invention to eliminate the aforementioned disadvantages of the conventional apparatus for optically detecting the amount of the residual or leftover bobbin thread.

Another object of the invention is to provide an apparatus for detecting the amount of the residual or leftover bobbin thread, which is capable of reliably detecting the amount of the bobbin thread when the remaining thread reaches a predetermined minimal amount.

SUMMARY OF THE INVENTION

To accomplish these and other objects of the invention, a sewing machine is provided which includes an optical sensor, a detection mechanism and a counting mechanism. In preferred embodiments, the invention may include a bobbin having flanges with a plurality of reflective elements, wherein the flanges have a plurality of holes, an illumination mechanism to cast light upon the reflective elements, a receptor to receive and detect reflected light, a sensor to detect and a counter to count the revolutions of the main shaft of the sewing machine, a detector to detect and a comparator to compare the rotation speed of the bobbin with a preset value, a control, and an alarm.

BRIEF DESCRIPTION OF THE DRAWINGS

The invention will be described in greater detail below by way of reference to the attached drawings, in which.

DETAILED DESCRIPTION OF THE INVENTION

Figure 1A:
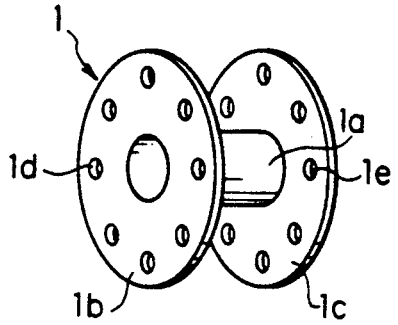
FIGS. 1A and lB are perspective and front views of a bobbin according to a first embodiment of the invention.
Figure 1B:
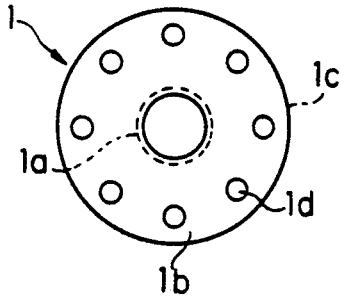

FIGS. 1A and 1B show a bobbin 1 which is rotatably mounted in a rotating hook well-known in the art. Bobbin 1 includes a takeup shaft 1*a* on which a bobbin thread is wound, and a pair of annular flanges 1*b* and 1*c* on the opposite ends of the takeup shaft 1*a*. The flanges 1*b* and 1*c* have a plurality of holes 1*d* and 1*e* through the flanges 1*b* and 1*c*, said holes concentrically and radially placed and equidistantly spaced along said flanges. In this connection, it is noted that the bobbin 1 is designed for general use and not specifically machined for the purpose of application of the instant invention. Holes 1*d* and 1*e* are of a type commonly found in bobbins, and are adapted for making bobbin 1 lightweight.

Figure 2:
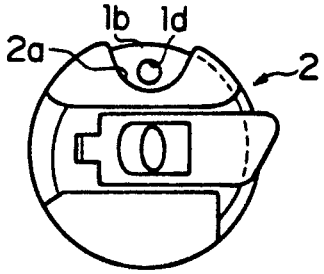
FIG. 2 is a front view of a bobbin case.

FIG. 2 shows a bobbin case 2 as found in one embodiment of the present invention. Said case has a notch 2*a* in its frame that exposes one of the holes 1*d* or 1*e* which are bored through flange 1*b* or 1*c* of the bobbin 1 which is placed within the bobbin case 2. Bobbin case 2 is also of a popular type generally used and not specifically configurated for use in the instant invention.

Figure 3:
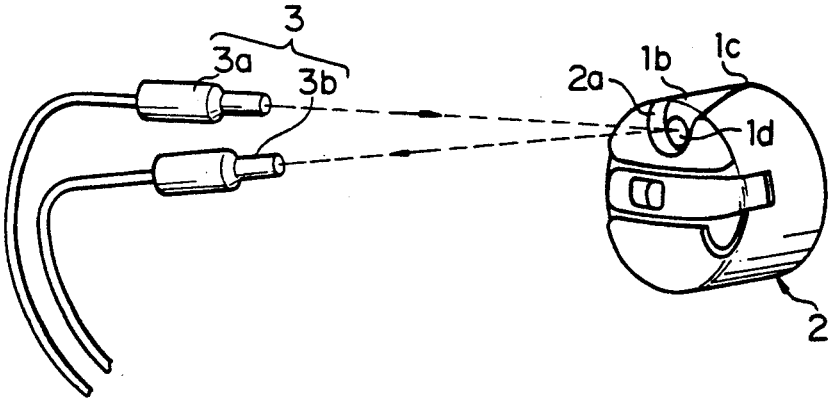
FIG. 3 is a perspective view of a photo sensor.
Figure 4:
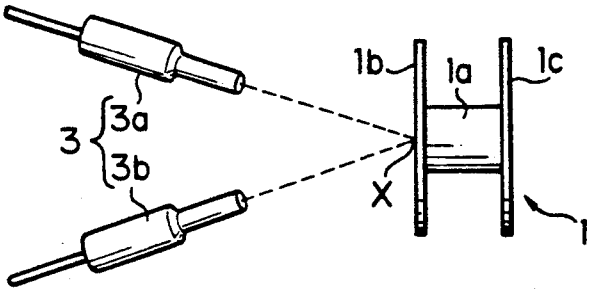
FIG. 4 is a plan view of the photo sensor.
Figure 5:
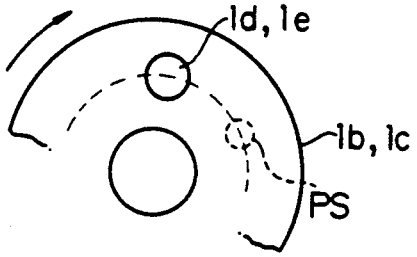
FIG. 5 is a simplified representation of the manner in which the photo sensor is illuminated.
Figure 6:
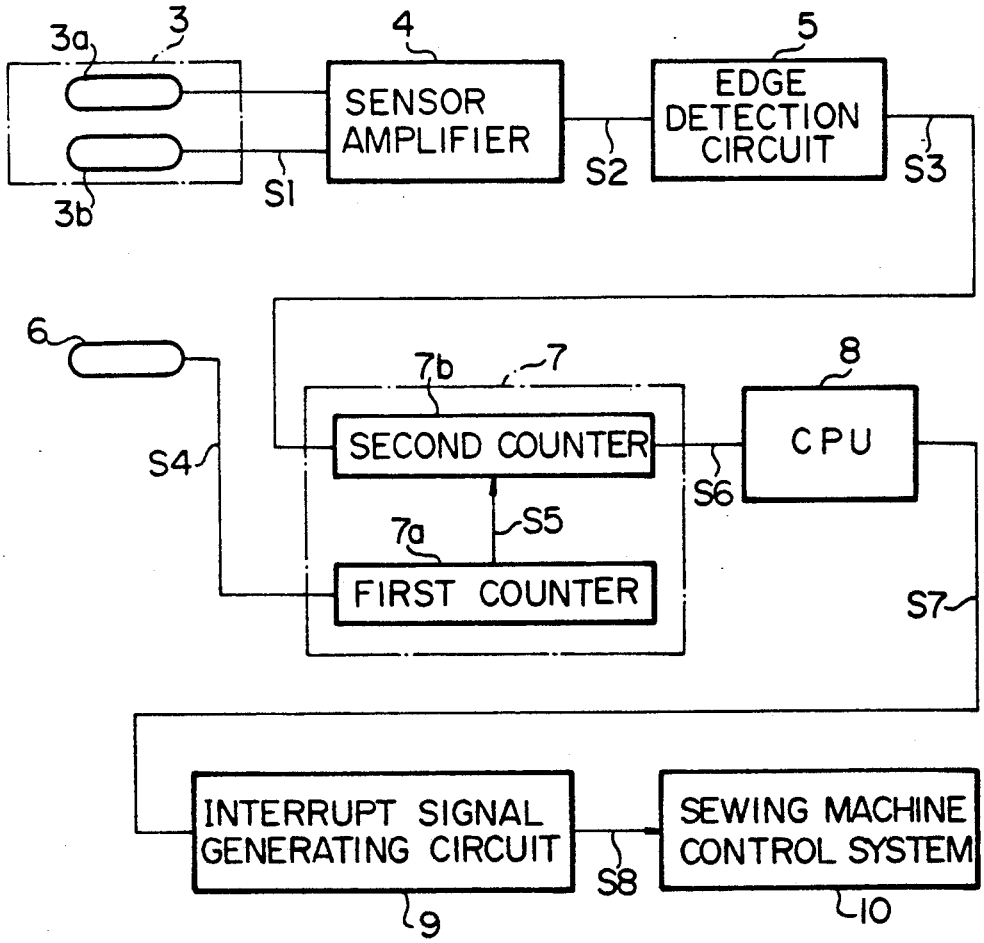
FIG. 6 is a block diagram of the first embodiment.
Figure 7:
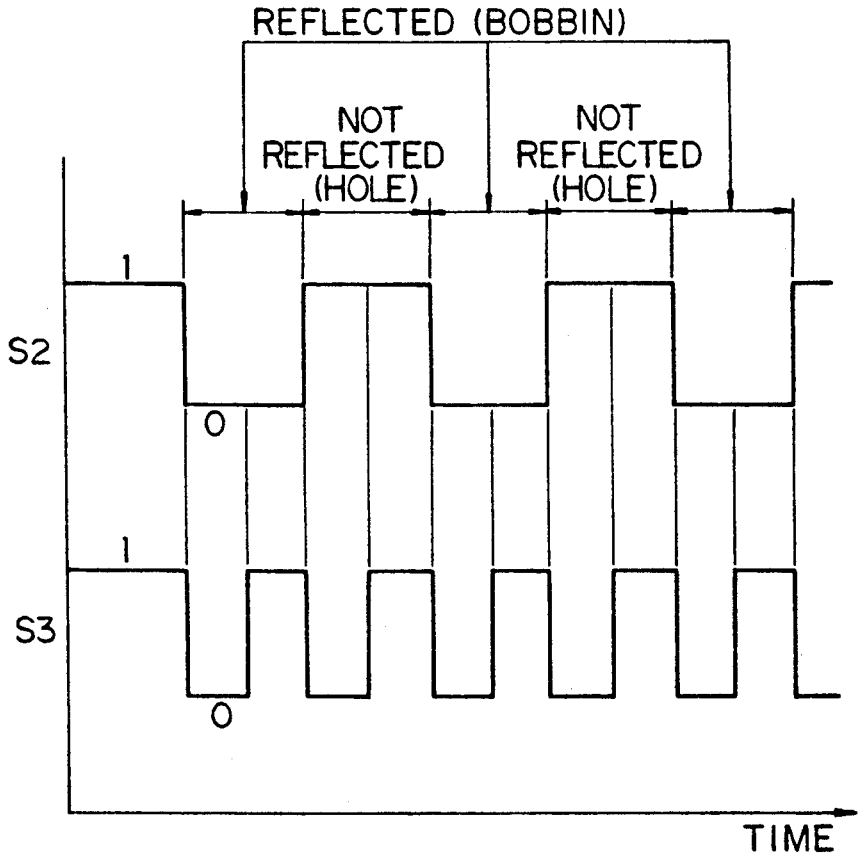
FIG. 7 is a representation showing waveforms of the output pulse derived from the photo sensor and the edge detection circuit shown in FIG. 6.

FIGS. 3 and 4 show a photo sensor 3 disposed facing a hook (not shown). The photo sensor 3 includes an illuminative optical fiber 3*a* or light emission element, and a light receptive optical fiber 3*b* or light receptive element. Light projected from the illuminative optical fiber 3*a* passes through the notch 2*a* in the bobbin case 2 and is then irradiated onto the flange 1*b* of the bobbin 1. As seen in FIG. 5, the emitted light strikes flange 1*b* or 1*c*, passes through holes 1*d* or 1*e*, and as the bobbin 1 rotates a moving circular locus PS is formed by the light passing through the center of said holes. Although the light projected onto the face of flange 1*b* is reflected, those light rays passing through the holes 1*d* are not. The light reflected off the flange face is then detected by the light receptive optical fiber 3*b*. This reflected light is then converted into an electrical signal, and this signal is then outputted to a sensor amplifier 4, as shown in FIG. 6. Thus, the light projected from the light receptive optical fiber 3*b* is intermittently reflected prior to rotation of the bobbin 1 so that the electrical signal outputted to the sensor amplifier 4 is a pulse signal, as shown in FIG. 7.

FIG. 6 is a block diagram of the apparatus according to the invention, in which there is shown an edge detection circuit 5 that outputs a fixed pulse signal S3 in response to both leading and trailing edges of a pulse signal S2 fed from the sensor amplifier 4. A sensor 6 detects the rotation speed of a main shaft of the sewing machine. Sensor 6 is adapted to output one pulse signal S4 for each revolution of the main shaft.

A signal processing circuit 7 includes first and second counters 7*a* and 7*b*. The first counter 7*a* is connected to sensor 6 and counts the number of pulses S4 outputted from sensor 6. First counter 7*a* outputs one pulse signal S5 to the second counter 7*b* when the accumulated count equals a predetermined value. This counting operation is repeatedly performed. Means for detecting the rotation speed of the main shaft is thus formed by the first counter 7*a* and the sensor 6. The second counter 7*b* (counting means) is connected to the edge detection sensor circuit 5. Second counter 7*b* counts the number of pulses outputted from edge detection sensor circuit 5 between the pulses outputted from the first counter 7*a*, i.e., second counter 7*b* counts the number of holes 1*d* found during one revolution of the bobbin. These counted pulse values S6 are then fed into a CPU 8 annexed thereto.

The counted values fed from the second counter 7*b* are stored in successive memory locations accommodated in the CPU 8. As is well known, a CPU such as CPU 8 performs various computing and control functions and, in this instance, it functions as a computer means, a control means, a comparison means, and a memory means. In response to an error signal S7 applied from the CPU, an interrupt signal generating circuit 9 transmits an interrupt signal S8 to a control circuit 10 for the sewing machine.

The manner of operation of the apparatus for detecting the amount of leftover bobbin thread arranged as aforementioned will be explained with reference to the flowchart shown in FIGS. 8 and 9. As shown in step 1, when the power is turned on, the respective parts of the instant apparatus as well as the sewing machine are initialized. In step 2, a stitch pitch p and a fabric thickness t, both in millimeters, are inputted by the operator via an input means (not shown). The CPU 8 in step 3 then calculates a threshold value for determining the amount of leftover bobbin thread according to the aforementioned data, as will be described later.

Figure 8:
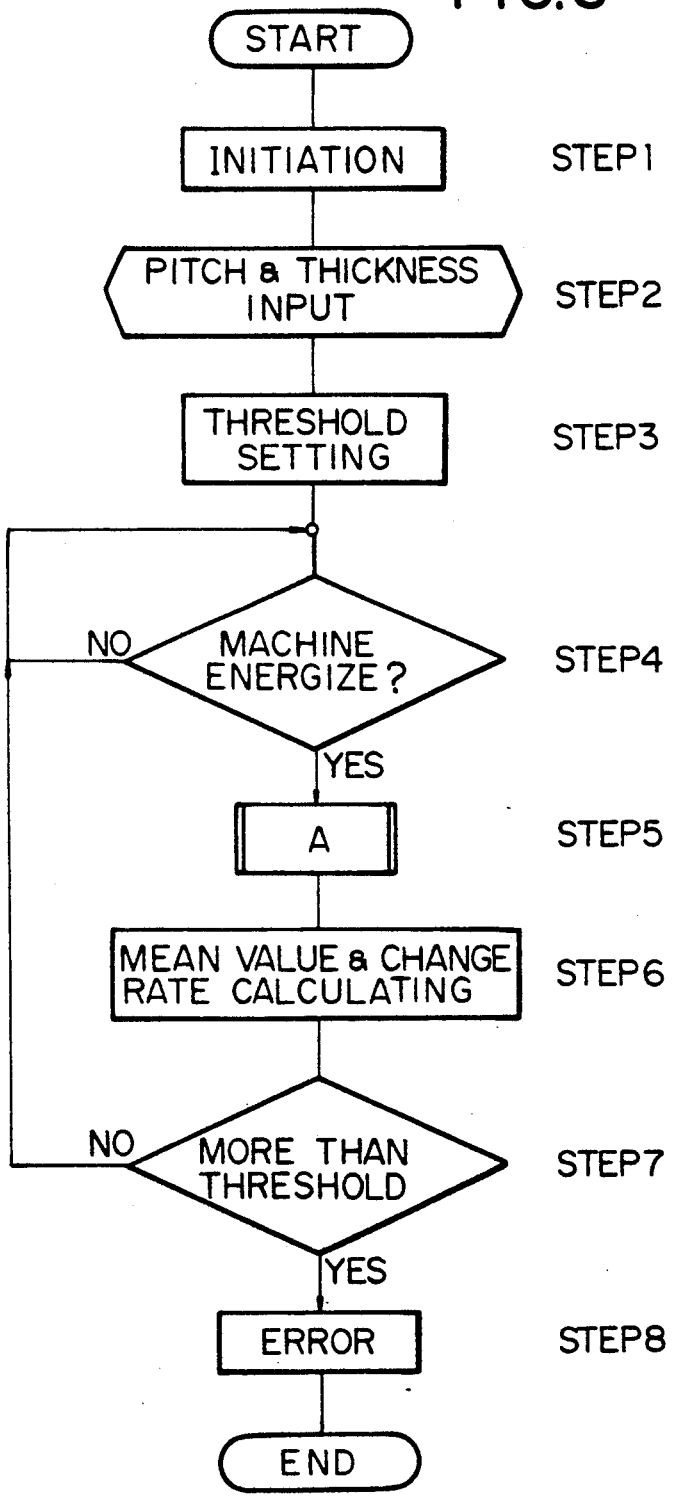
FIGS. 8 and 9 illustrate a control flowchart.

In step 4, a signal for starting the sewing machine is then inputted to the control circuit 10 to perform an operation designated by A, step 5 in FIG. 8. As shown more specifically in FIG. 9, first counter 7*a* counts the number of rotations of the main shaft of the sewing machine from pulses S4 from sensor 6.

A sewing operation is started to spend and pay out the bobbin thread in a fixed amount every stitch, thereby rotating the main shaft. This rotation allows photo sensor 3 to output the pulse signal S2 with a fixed pulse width, as shown in FIG. 7. A pulse signal S3 as illustrated in FIG. 7 is outputted from an edge detection circuit synchronously with the leading and trailing edges of the pulse S2. As shown in steps A4–A6 in FIG. 9, pulse signal S3 is inputted to the second counter 7*b* where the pulse number is counted.

The main shaft of the sewing machine is then rotated N turns (for example, 50 turns in this instance) to perform the sewing operation for N stitches, thereby outputting one pulse signal S5 from the first counter 7*a* to the second counter 7*b*. Thus, the counted value thusfar is outputted from the second counter 7*b* to the CPU 8, and stored in a memory location within CPU 8, as shown in steps A7 and A8. The aforementioned operation is repeated until one sewing cycle is completed to successively store the data for N stitches in the CPU 8, as shown by Step A9.

Referring now to FIG. 8, upon completion of one sewing cycle, CPU 8 evaluates the mean value of the counted values for each of N stitches as stored in the memory, and then stores this mean value in a fixed memory location. This most recent mean value is then compared to the previous mean value obtained during the sewing operation. Using this comparison, the CPU 8 calculates a coefficient of change between the mean values, as shown in Step 6. The CPU 8 then compares the calculated mean value with the aforementioned preset threshold value.

The preset threshold value is the pulse number count of pulse signal S3 outputted from the edge detection circuit 5 where the residual bobbin thread is at a predetermined level when a replacement bobbin is required. The payout amount L in millimeters of the thread per N stitches can be expressed by means of the following equation:

$$L=N\times(p+2\times(t/2))$$

or more simply:

$$L=N\times(p+t)$$

where p is the stitch pitch and t is the fabric thickness.

On the other hand, the rotation speed c of the bobbin per the unit length can be obtained from the following equation:

$$c=K/(\pi\times D)$$

where D is the winding diameter in millimeters of the residual thread still wound on the bobbin to be detected, and K is the pulse number.

The rotation rate c in this instance may be expressed by the following equation where the flange 1*b* of bobbin 1 is formed with eight holes to find in terms of 16 the value of K:

$$c=16/(\pi\times D)$$

From the foregoing, the pulse number, namely, threshold $P_{th}$ which is obtained by the main shaft making N revolutions, provided that the winding diameter of the thread is D, is formalized as follows:

$$P_{th}=c\times L$$

which upon substitution becomes:

$$P_{th}=16N\times(p+t)/(\pi\times D)$$

According to the instant embodiment, CPU 8 is adapted to automatically calculate the threshold $P_{th}$ by causing the input means (not shown) to input the stitch pitch p and fiber thickness t so that the threshold $P_{th}$ may be readily set, as shown at step 2 in FIG. 8.

Where the mean value obtained during machine operation is more than the above calculated threshold $P_{th}$ value, CPU 8 outputs a control signal S7, which in turn allows an interrupt signal generating circuit 9 to output an interrupt signal S8 to a sewing machine control circuit 10. In this manner, the control circuit 10 is actuated, interrupting and stopping the sewing machine and also operating an alarm means, such as a buzzer or a lamp, thereby notifying the operator of a shortage of bobbin thread.

In the instant embodiment, detection of the amount of leftover thread is made according to a large number of rotations of the main shaft. Thus, measurement is not subjected to variations in sewing speed during each sewing cycle and the variations in the rotation speed of the bobbin while it turns. Further, the values as counted for every N stitches are averaged so as to minimize errors to a negligible extent, thereby ensuring a more accurate detection of the true amount of residual thread remaining even if one particular value varies greatly from the others.

Since the possibility of error is reduced in computing the pulse values for the bobbin rotation, these errors need not be considered. If errors are not taken into account, then the counted value may be compared with the threshold after every N stitches. In this instance, another advantage is obtained in that a shortage of the amount of residual thread may be detected during a single sewing cycle, as compared with what is discussed in the above embodiment.

In accordance with the embodiment, a coefficient of change may be calculated according to the latest mean value as calculated and the previous mean value as calculated by the sewing operation so that the operator is able to determine how much thread remains. For this reason, it is possible to prepare the next bobbin beforehand, thereby improving operation efficiency.

Figure 9:
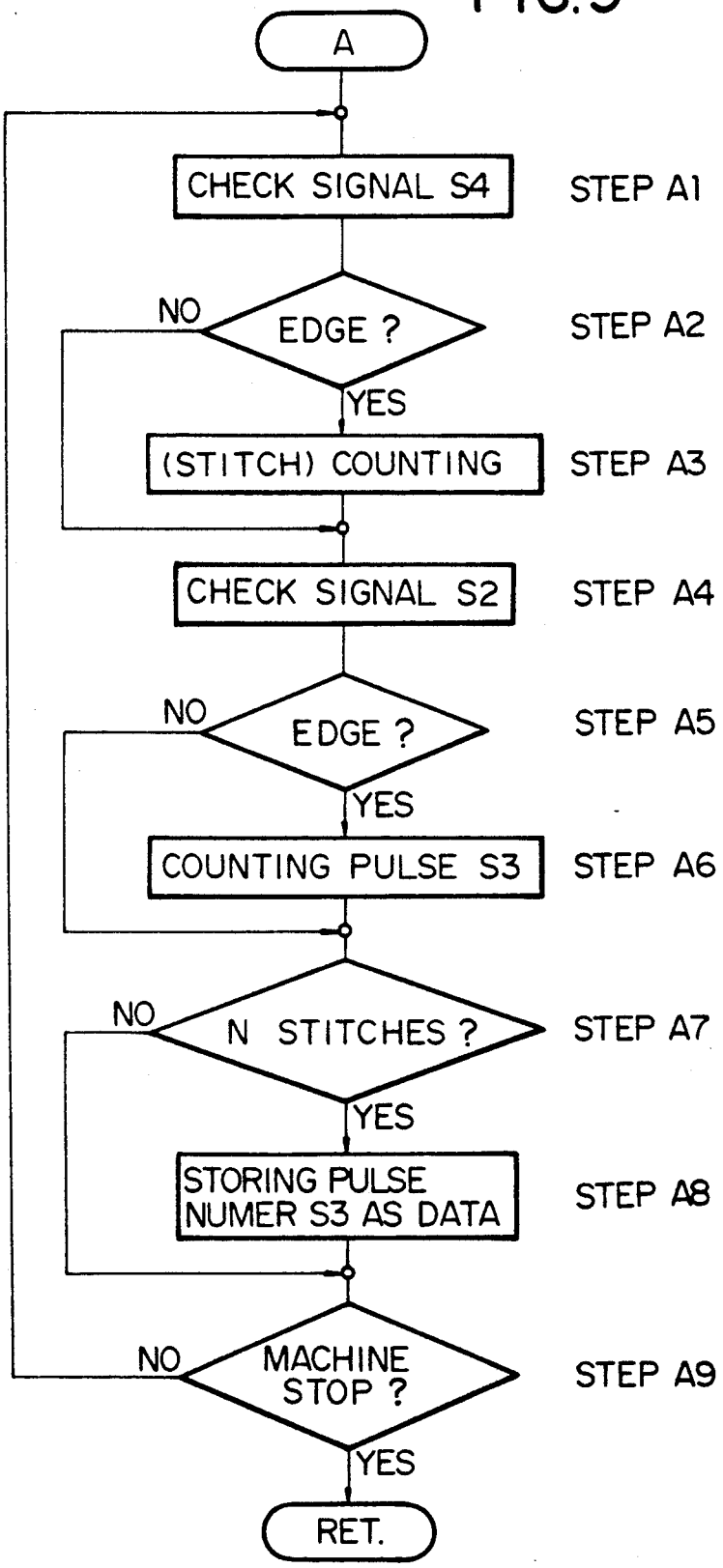
Figure 10A:
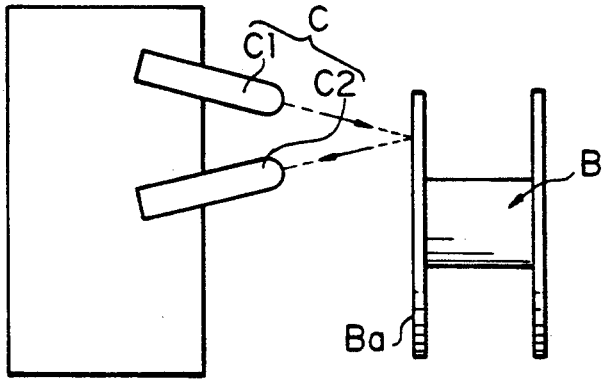
FIG. 10A is a side view showing a photo sensor of a conventional apparatus for detecting the amount of the residual or leftover bobbin thread.
Figure 10B:
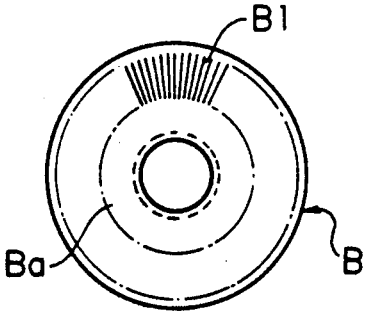
FIG. 10B is a front view of the bobbin shown in FIG. 10A.

Although each of the steps of the routine identified as A1-A9 of FIG. 9 are carried out by a signal processing means which is provided with the first and second counters, this is also made by means of a control circuit such as a CPU or the like which performs the same functions. It is noted that the invention is not limited to the aforementioned embodiment.

The overall operation of the present invention is as follows. The pulse number transmitted from the light receptive element is counted at every fixed rotation of the main shaft in response to the light reflected from the flange of the bobbin. These counted values are successively taken up during one sewing cycle and compared with the fixed threshold value by the comparison means. This threshold is the value which is transmitted from the light receptive element by rotating the main shaft a fixed turn where the amount of the residual thread remaining on the bobbin is low. A comparison is made between the threshold value and the counted value. Where the counted value is more than the threshold value, an alarm means is activated, thereby notifying the operator that the amount of leftover thread is less than the predetermined fixed amount.

In other words, the number of rotations of the bobbin with respect to the rotation speed of the main shaft are detected, thereby detecting the amount of residual thread. Thus, an accurate detection of the amount of residual thread may be made without being affected by a change in the rotation speed of the bobbin during one sewing operation or one revolution.

Moreover, the many counted values obtained whenever the main shaft is rotated a fixed number of turns, as aforementioned, are successively stored during each sewing cycle. The mean value of these computed values for one sewing cycle is calculated and compared with the threshold value. Errors produced in calculating the threshold value may thus be minimized to a negligible extent, thereby ensuring an accurate detection of the amount of residual thread.

Although the invention has been described with a preferred embodiment, it is to be understood that various changes, substitutions and alterations can be made therein without departing from the spirit and scope of the invention as defined by the appended claims.

I claim:

1. A sewing machine, comprising:

a hook rotating in association with a main shaft of the sewing machine;

a bobbin rotatably mounted on said hook;

first detection means for detecting the rotation speed of the main shaft;

second detection means for detecting the rotation speed of said bobbin;

comparison means responsive to said second detection means to generate a signal when said rotation speed of said bobbin exceeds a predetermined value; and control means responsive to said signal from said comparison means to operate an alarm means.

2. The sewing machine according to claim 1 wherein said bobbin comprises a pair of flanges, each of said flanges having a plurality of holes, each of said holes being circumferentially and spacedly formed;

said second detection means comprises:

light emission means disposed oppositely towards one of said flanges of said bobbin;

light receptive means for receiving light reflected by said flange from said light emission means; and counting means for counting pulses from said light receptive means.

3. The sewing machine according to claim 2, wherein said first detection means detects said rotation speed of the main shaft at a fixed rotation; and said counting means counts said pulses from said light receptive means at every fixed rotation of the main shaft.

4. The sewing machine according to claim 2, wherein said predetermined value equals a counted pulse number from said light receptive means as said main shaft rotates at a predetermined speed when the residual bobbin thread of said bobbin reaches a predetermined amount.

5. A sewing machine comprising:

a hook rotating in association with a main shaft of the sewing machine;

a bobbin rotatably mounted on said hook;

first detection means for detecting the rotation speed of the main shaft at every fixed rotation;

second detection means for detecting the rotation speed of said bobbin;

calculation means for continuously calculating a mean value pertaining to a number of bobbin rotations during a sewing operation cycle;

comparison means responsive to said second detection means to generate a signal when said mean value exceeds a predetermined value; and control means responsive to said signal from said comparison means to operate an alarm means.

6. The sewing machine according to claim 5, wherein said bobbin comprises a pair of flanges, each of said flanges having a plurality of holes, each of said holes being circumferentially and spacedly formed;

said second detection means comprises:

light emission means disposed oppositely towards one of said flanges of said bobbin;

light receptive means for receiving light reflected by said flange from said light emission means; and counting means for counting pulses from said light receptive means.

7. The sewing machine according to claim 5, wherein said first detection means detects said rotation speed of the main shaft at every fixed rotations; and said counting means counts said pulses from said light receptive means at every fixed rotation of the main shaft.

8. The sewing machine according to claim 6, wherein said predetermined value equals a counted pulse number from said light receptive means as said main shaft rotates at a predetermined speed when the residual bobbin thread of said bobbin reaches a predetermined amount.

9. A sewing machine having a bobbin rotatably mounted on a hook rotating in association with a main shaft of the sewing machine, comprising:

first detection means for generating at least one first pulse relative to the rotation of said main shaft;

second detection means for generating a plurality of second pulses relative to the rotation of said bobbin;

a first counter for counting said first pulses and generating a signal relative to a counting of a predetermined number of said first pulses;

a second counter for counting a count value of said second pulses generated during each generation of said signal from said first counter;

comparison means for comparing said count value of said second pulses with a setting value and generating an alarm signal when said count value exceeds said setting value;

set means for setting said setting value; and control means responsive to said alarm signal to operate an alarm means.

10. A sewing machine according to claim 9 wherein said set means includes input means for inputting the stitch pitch and thickness of a workpiece, and operating means for operating said setting value.

11. A sewing machine having a bobbin rotatably mounted on a hook rotating in association with a main shaft of the sewing machine, comprising:

first detection means for generating at least one first pulse relative to the rotation of said main shaft;

second detection means for generating a plurality of second pulses relative to the rotation of said bobbin;

a first counter for counting said first pulses and generating a signal relative to a counting of a predetermined number of said first pulses;

a second counter for counting and generating a count value of said second pulses generated during each generation of said signal from said first counter;

memory means for storing each count value of said second pulses;

operative means for calculating an average value on the basis of said count value stored in said memory;

comparison means for comparing said average value with a setting value and generating an alarm signal when said average value exceeds said setting value;

set means for setting said setting value; and control means responsive to said alarm signal to operate an alarm means.

12. The sewing machine according to claim 11 wherein said set means includes input means for inputting the stitch pitch and thickness of a workpiece, and operating means for operating said setting value.

* * * * *